US010481519B2

(12) United States Patent
Yano et al.

(10) Patent No.: US 10,481,519 B2
(45) Date of Patent: Nov. 19, 2019

(54) PRINT HEAD AND IMAGE FORMING APPARATUS

(71) Applicant: Konica Minolta, Inc., Chiyoda-ku, Tokyo (JP)

(72) Inventors: So Yano, Ibaraki (JP); Yoshikazu Watanabe, Toyohashi (JP); Sotaro Yokota, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 156 days.

(21) Appl. No.: 15/704,517

(22) Filed: Sep. 14, 2017

(65) Prior Publication Data

US 2018/0074432 A1 Mar. 15, 2018

(30) Foreign Application Priority Data

Sep. 15, 2016 (JP) ..... 2016-180631

(51) Int. Cl.
*G03G 15/04* (2006.01)
*G03G 15/043* (2006.01)

(52) U.S. Cl.
CPC ..... *G03G 15/043* (2013.01); *G03G 15/04054* (2013.01)

(58) Field of Classification Search
CPC ..... G03G 15/043; G03G 15/04054; G03G 15/04063
See application file for complete search history.

(56) References Cited

U.S. PATENT DOCUMENTS 7,911,492 B2 * 3/2011 Tsujino ..... B41J 2/45 347/236

FOREIGN PATENT DOCUMENTS

| | | | |
|---|---|---|---|
| JP | 2005-329636 | A | 12/2005 |
| JP | 2007-017479 | A | 1/2007 |
| JP | 2010-169733 | A | 8/2010 |

* cited by examiner

*Primary Examiner* — Hoang X Ngo
(74) *Attorney, Agent, or Firm* — Buchanan Ingersoll & Rooney PC

(57) ABSTRACT

A print head includes: current-driven non-single crystal light emitting elements arranged in a line; thin film transistors that are provided in one-to-one correspondence with the light emitting elements and each supplies a driving current to a corresponding one of the light emitting elements; a detector that detects, when one of the light emitting elements corresponding to one of the thin film transistors emits light, an output voltage of the one of the thin film transistors; and a hardware processor that determines a control voltage to be applied to each of the thin film transistors when next light is emitted according to the output voltage of the one of the thin film transistors detected by the detector and a driving current to be supplied by each of the thin film transistors to cause each of the light emitting elements to emit light with a target light amount.

15 Claims, 10 Drawing Sheets

FIG. 7

503

| | | OLED NUMBER | | | |
|---|---|---|---|---|---|
| | | 1 | 2 | ··· | 15000 |
| LIGHT AMOUNT | La | Ila1 | Ila2 | ··· | Ila15000 |
| | Lb | Ilb1 | Ilb2 | ··· | Ilb15000 |
| | Lc | Ilc1 | Ilc2 | ··· | Ilc15000 |
| | Ld | Ild1 | Ild2 | ··· | Ild15000 |

FIG. 8

504

TEMPERATURE = 80°C

⋰

TEMPERATURE = 10°C

TEMPERATURE = 0°C

| | | CUMULATIVE LIGHT EMISSION TIME (h) | | | |
|---|---|---|---|---|---|
| | | 50 | 100 | ··· | 1000 |
| LIGHT AMOUNT | La | Cla50 | Cla100 | ··· | Cla1000 |
| | Lb | Clb50 | Clb100 | ··· | Clb1000 |
| | Lc | Clc50 | Clc100 | ··· | Clc1000 |
| | Ld | Cld50 | Cld100 | ··· | Cld1000 |

| FACTOR | | INITIAL VARIATION | FLUCTUATION OVER TIME |
|---|---|---|---|
| TFT | THRESHOLD VOLTAGE Vth | EXIST | SMALL |
| | MOBILITY $\mu$ | EXIST | SMALL |
| | SHIFT OF SOURCE–DRAIN VOLTAGE Vsd IN SATURATION REGION | NONE | NONE |
| OLED | FORWARD VOLTAGE Vel | EXIST | LARGE |
| | LIGHT EMISSION EFFICIENCY $\alpha$ | EXIST | LARGE |

PRINT HEAD AND IMAGE FORMING APPARATUS

Japanese Patent Application No. 2016-180631 filed on Sep. 15, 2016, including description, claims, drawings, and abstract the entire disclosure is incorporated herein by reference in its entirety.

BACKGROUND

Technological Field

The present invention relates to a print head and an image forming apparatus, and more particularly, relates to a technology for correcting variation in a light amount due to fluctuation of a voltage in a forward direction of an OLED and a characteristic of a TFT which supplies a driving current to the OLED.

Description of the Related Art

In recent years, there has been an increasing demand for downsizing of image forming apparatuses, and an optical scanning system using a conventional laser diode (LD) as a light source is shifting to a line optical system in which minute dot light emitting elements are arranged in a line to downsize a print head (PH).

Furthermore, there has been also a growing demand for cost reduction of the image forming apparatus, and an organic light emitting diode (OLED) PH in which OLEDs are applied to light emitting elements attracts attention as a technology for reducing costs of a line optical system print head. In an OLED-PH, an OLED which is a current-driven light emitting element and a thin film transistor (TFT) which supplies a driving current to the OLED and controls the light emission amount can be formed on the same substrate, and it is possible to reduce manufacturing costs.

OLEDs are applied not only to OLED-PHs but also to image receivers. In an image receiving apparatus, since many OLEDs are two-dimensionally arranged and a moving image is displayed, variation in the light amount between the OLEDs is permitted up to 30%. On the other hand, in an OLED-PH, if variation in the light amount exceeds 1%, the influence on the printed image is visually recognized, and which cannot be practically used. Thus, in the OLED-PH, it is necessary to correct the variation in the light amount with high accuracy.

For example, in an OLED-PH having about 15,000 light emitting circuits arranged in the main scanning direction in each of which an OLED as shown in FIG. 11 and a TFT which supplies a driving current according to a gate-source voltage Vgs to the OLED are combined, if the same gate-source voltage Vgs is input to each TFT, the light amount of each OLED is not necessarily to be constant but varies. Such variation in the light amount can be caused by the factors as shown in FIG. 12.

When the threshold voltage Vth and the mobility μ fluctuates among these factors, the driving current (drain current) Id fluctuates because the driving current Id supplied by the TFT is substantially proportional to the threshold voltage Vth and the mobility μ. Furthermore, since the light amount of the OLED is substantially proportional to the light emission efficiency a and the driving current Id, variation in the light amount occurs if the threshold voltage Vth and the mobility μ of the TFT, and the light emission efficiency a of the OLED fluctuates.

For this reason, there has been proposed a technique in which, for example, the gate-source voltage Vgs when a desired driving current is applied to the TFT is held by a capacitor and the gate-source voltage Vgs held by the capacitor is applied to the TFT when the OLED emits light. With this technique, it is possible to eliminate variation in the light amount due to the fluctuation of the threshold voltage Vth of the TFT (see JP 2012-58428 A).

There has been also proposed a technique in which all OLEDs are caused to emit light under the same condition to detect the light amount emission of each OLED and the drive condition is corrected for each OLED according to the detected light amount. With this technique, it is possible to eliminate variation in the light amount caused by fluctuation of the light emission efficiency a of the OLED (see JP 2005-329634 A).

[Patent Document 1] JP 2012-58428 A
[Patent Document 2] JP 2005-329634 A
[Patent Document 3] JP 2004-252036 A
[Patent Document 4] JP 2005-352148 A However, as shown in FIG. 11, when the driving current Id is changed according to the change of the light emission efficiency of the OLED while the fixed voltage Vdd is being applied to the series circuit of the TFT and the OLED, the forward voltage Vel of the OLED changes, and the source-drain voltage Vsd of the TFT changes accordingly.

As shown in FIG. 13, the drain current Id changes when the source-drain voltage Vsd changes in the saturation region of the TFT. Thus, although variation in the light amount is caused due to the shift of the source-drain voltage Vsd in the saturation region of the TFT and the fluctuation of the forward voltage Vel of the OLED, the variation in the light amount caused by these factors cannot be eliminated with some conventional techniques.

Furthermore, if a light amount sensor for detecting the light amount of each OLED is added to eliminate variation in the light amount, the advantage of an OLED-PH that is being effective for cost reduction is diminished, and which is undesirable.

SUMMARY

The present invention has been made in view of the above problems, and an object thereof is to provide a print head and an image forming apparatus which are capable of suppressing variation in a light amount due to shift of a source-drain voltage Vsd in a saturation region of a TFT and fluctuation of a forward voltage Vel of an OLED without increasing costs.

To achieve the abovementioned object, according to an aspect of the present invention, a print head reflecting one aspect of the present invention comprises: a plurality of current-driven non-single crystal light emitting elements arranged in a line; a plurality of thin film transistors that is provided in one-to-one correspondence with the plurality of light emitting elements and each supplies a driving current to a corresponding one of the plurality of light emitting elements; a detector that detects, when one of the plurality of light emitting elements corresponding to one of the plurality of thin film transistors emits light, an output voltage of the one of the plurality of thin film transistors; and a hardware processor that determines a control voltage to be applied to each of the plurality of thin film transistors when next light is emitted according to the output voltage of the one of the plurality of thin film transistors detected by the detector and a driving current to be supplied by each of the plurality of thin film transistors to cause each of the plurality of light emitting elements to emit light with a target light amount.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention:

FIG. 7 is a table exemplifying an Id initial data table;

FIG. 8 is a table exemplifying an Id correction coefficient table;

DETAILED DESCRIPTION OF EMBODIMENTS

Hereinafter, a print head and an image forming apparatus according to one or more embodiments of the present invention will be described with reference to the drawings. However, the scope of the invention is not limited to the disclosed embodiments.

[1] Configuration of Image Forming Apparatus

First, a configuration of an image forming apparatus according to the present embodiment will be described.

Figure 1:
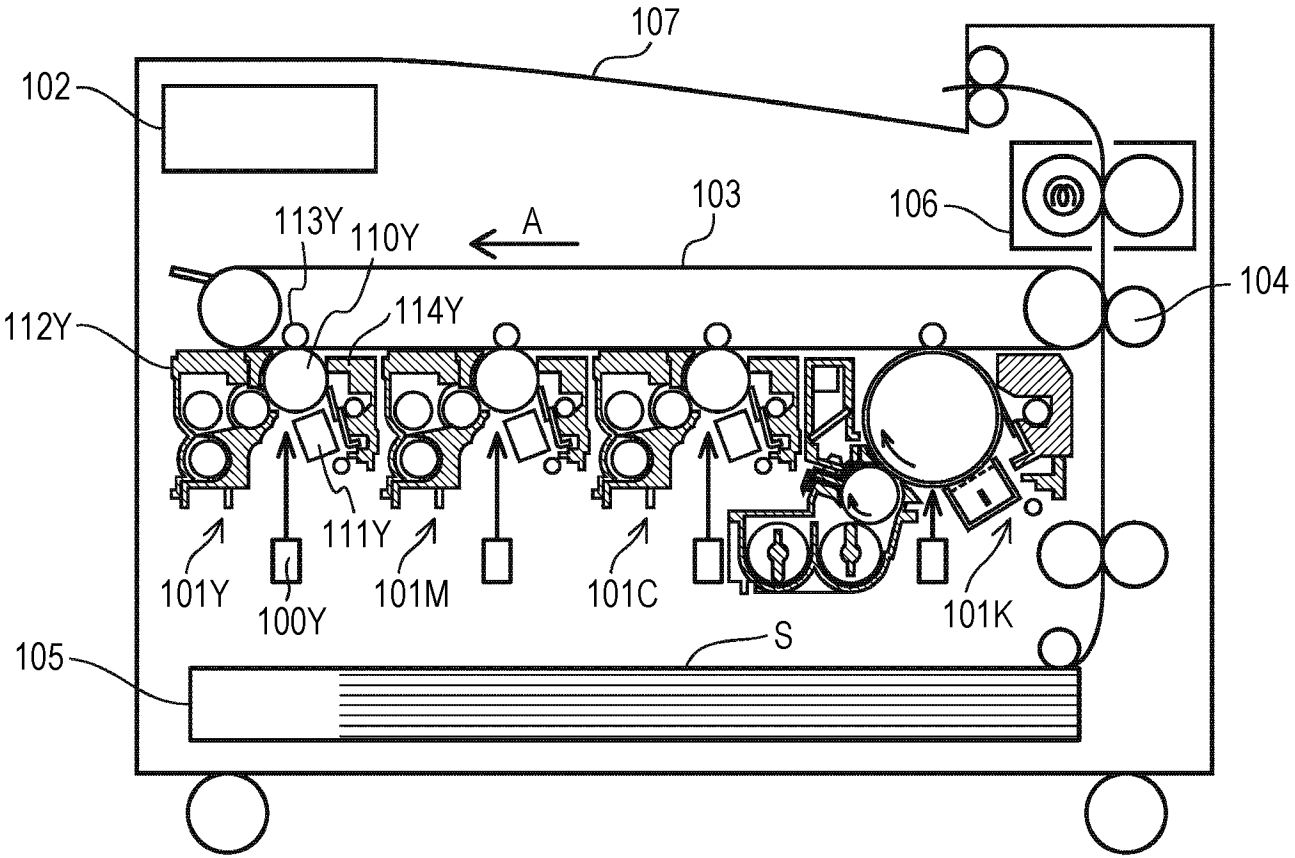
FIG. 1 is a diagram showing a main configuration of an image forming apparatus according to an embodiment of the present invention.

As shown in FIG. 1, an image forming apparatus 1 is what is called a tandem type color printer, and image forming stations 101Y, 101M, 101C, and 101K form toner images in yellow (Y), magenta (M), cyan (C), and black (K). The image forming station 101Y uniformly charges the outer circumferential surface of a photosensitive drum 110Y with a charging device 111Y A print head 100Y is an OLED-PH, and forms an electrostatic latent image by optical writing.

A developing device 112Y supplies Y color toner to develop the electrostatic latent image, and a primary transfer roller 113Y electrostatically transfers the Y color toner image carried on the outer circumferential surface of the photosensitive drum 110Y onto an intermediate transfer belt 103. Then, a cleaning device 114Y removes residual toner on the outer circumferential surface of the photosensitive drum 110Y and eliminates the residual electric charge.

The image forming stations 101M, 101C, and 101K each have a similar configuration, and form a toner image in each color of M, C, and K by a similar operation. The toner images in the colors of Y, M, C, and K are sequentially electrostatically transferred so as to overlap each other on the intermediate transfer belt 103, and a color toner image is formed. The intermediate transfer belt 103 is an endless belt and conveys the color toner image to a pair of secondary transfer rollers 104 by rotating in the direction of the arrow A.

A sheet feeding cassette 105 stores recording sheets S. The recording sheet S is fed one by one according to forming of the color toner image, and conveyed to the pair of secondary transfer rollers 104, and the color toner image is electrostatically transferred thereon. Then, the color toner image is thermally fixed on the recording sheet S by a fixing device 106, and the recording sheet S is discharged onto a discharge tray 107.

A controller 102 controls the above image forming operations.

[2] Configuration of Print Head 100

Next, a configuration of a print head 100 will be described.

Figure 2:
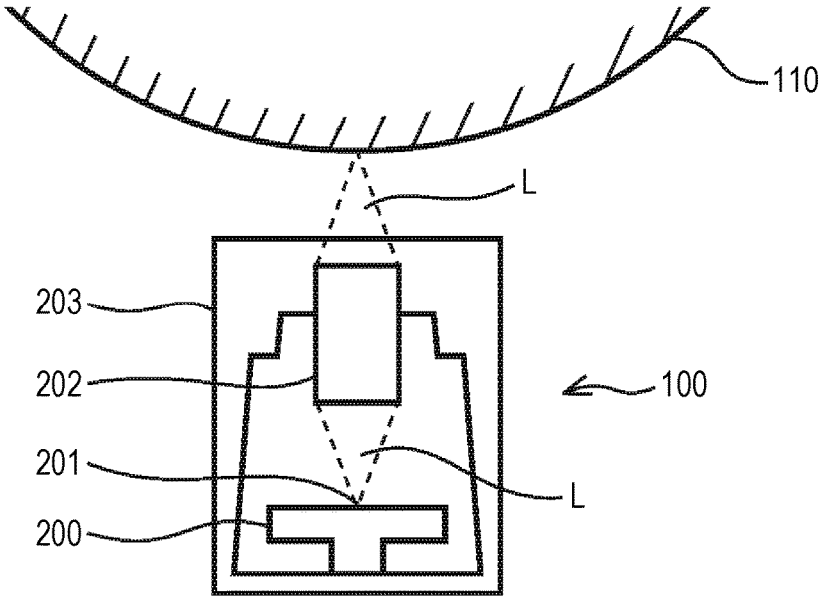
FIG. 2 is a diagram showing a main configuration of a print head.

As shown in FIG. 2, the print head 100 includes an OLED panel 200 and a rod lens array 202 which are housed in a housing 203. On the OLED panel 200, 15,000 OLEDs 201 are mounted in a line in the main scanning direction. The OLEDs 201 each emit a light beam L. The OLEDs 201 each are a current-driven light emitting element, and the light amount increases as the driving current increases. The OLEDs 201 each have a non-single crystal structure.

The 15,000 OLEDs 201 are mounted in a line at a pitch of 21.2 μm (1200 dpi) in the main scanning direction, and are divided into 150 light-emitting blocks each consisting of 100 OLEDs 201. The OLEDs 201 may be arranged in one row or in a staggered manner.

Figure 3:
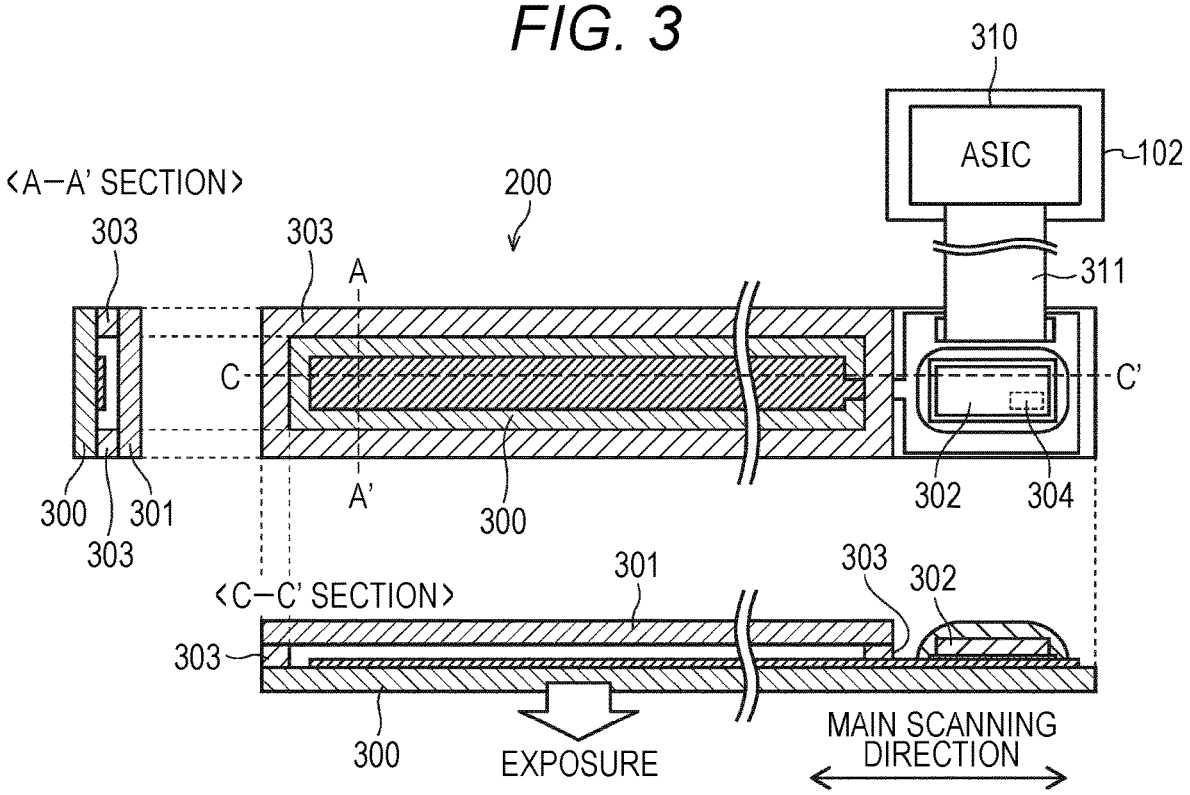
FIG. 3 is a schematic plan view showing an OLED panel from which a sealing plate is removed, a cross-sectional view taken along line A-A', and a cross-sectional view taken along line C-C'.

As shown in FIG. 3, the OLED panel 200 includes a TFT substrate 300 and the like. The OLEDs 201 are mounted on the TFT substrate 300, and the mounting region of the OLEDs 201 is sealed by attaching a sealing plate 301 with a spacer frame body 303 interposed therebetween. A driver integrated circuit (IC) 302 is mounted outside the sealing region of the TFT substrate 300. The driver IC 302 includes a temperature sensor 304 for detecting the environmental temperature of the OLEDs 201.

The controller 102 includes an application specific integrated circuit (ASIC) 310, and inputs image data to the driver IC 302 through a flexible wire 311. The driver IC 302 performs digital-to-analogue (DA) conversion to the image data, and generates a digital-to-analogue converter (DAC) signal for each OLED 201. The OLEDs 201 each emit light with a light amount according to the DAC signal.

[3] Configuration of TFT Substrate 300

Next, a configuration of the TFT substrate 300 will be described with reference to FIG. 4.

(3-1) Circuit Configuration for Causing OLED 201 to Emit Light

The TFT substrate 300 supplies a driving current according to the image data to the OLEDs 201 to cause the OLEDs 201 to emit light with a desired light amount.

(3-1-1) Light Emitting Block 400

Figure 4:
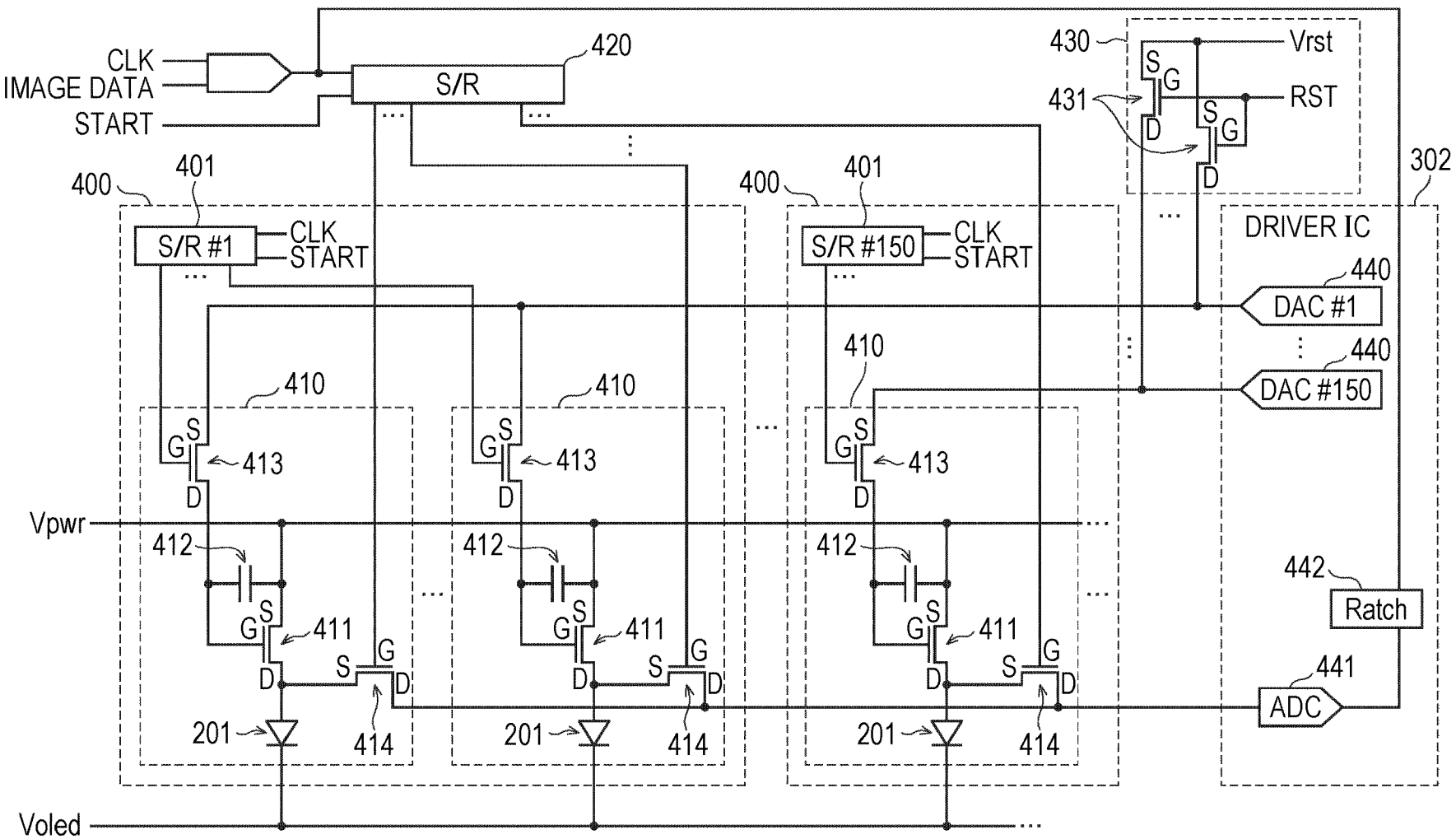
FIG. 4 is a circuit diagram showing a main configuration of a TFT substrate.

As shown in FIG. 4, 15,000 light emitting circuits 410 are mounted on the TFT substrate 300, and are grouped into 150 light emitting blocks 400 each consisting of 100 light emitting circuits 410. Each light emitting block 400 includes an OLED selecting shift register 401 in addition to the 100 light emitting circuits 410. The OLED selecting shift register 401 sequentially selects the light emitting circuit 410 for each main scanning period and inputs a pixel signal from a DAC 440 of the driver IC 302 to the selected light emitting circuit 410. One DAC 440 corresponds to one light emitting block 400, and 150 DACs 440 are incorporated in the driver IC 302.

(3-1-2) Light Emitting Circuit 410

The light emitting circuits 410 cause the OLEDs 201 to emit light.

The light emitting circuits 410 each have a similar configuration in which an OLED 201 and an OLED driving TFT 411 are connected in series. The source terminal of the OLED driving TFT 411 is connected with a power source Vpwr and one terminal of a capacitor 412, and the gate terminal is connected with the drain terminal of an OLED selecting TFT 413 and the other terminal of the capacitor 412. The drain terminal of the OLED driving TFT 411 is connected with the anode terminal of the OLED 201 and the source terminal of a Vsd detecting TFT 414. With this connection, the OLED driving TFT 411 supplies the drain current according to the holding voltage of the capacitor 412 to the OLED 201 as the driving current.

The source terminal of the OLED selecting TFT 413 is connected with the DAC 440 corresponding to the light emitting block 400 to which the OLED selecting TFT 413 belongs, and the gate terminal is connected with the OLED selecting shift register 401. The drain terminal of the OLED selecting TFT 413 is connected with one terminal of the capacitor 412. With this connection, when the OLED selecting shift register 401 turns on the OLED selecting TFT 413, a voltage according to the output signal of the DAC 440 is applied to the capacitor 412 and held during a holding period.

The anode terminal of the OLED 201 is connected with the drain terminal of the OLED driving TFT 411, and the cathode terminal is connected with a power source Voled. The OLED 201 is a current-driven light emitting element and emits with a light amount according to the driving current amount supplied from the OLED driving TFT 411 or extinguishes light. As described above, the driving current amount corresponds to the holding voltage of the capacitor 412 and the holding voltage of the capacitor 412 corresponds to the output signal of the DAC 440. Thus, the OLED 201 emits light with the light amount corresponding to the output signal of the DAC 440.

The source terminal of the Vsd detecting TFT 414 is connected with the drain terminal of the OLED driving TFT 411 and the anode terminal of the OLED 201, and the gate terminal is connected with a Vsd detecting shift register 420. The drain terminal of the Vsd detecting TFT 414 is connected with an analogue-to-digital converter (ADC) 441 of the driver IC 302. When the Vsd detecting shift register 420 turns on the Vsd detecting TFT 414, a drain voltage Vd of the OLED driving TFT 411 of the corresponding light emitting block 400 is input to the ADC 441.

The light emitting circuit 410 receives the pixel signal from the DAC 440 by turning on and off the OLED selecting shift register 401. A period in which the pixel signal is received from the DAC 440 within one main scanning period is referred to as a sampling period, and a period in which the received image signal is held is referred to as a holding period.

The sampling periods of the 100 light emitting circuits 410 belonging to one light emitting block 400 are shifted from each other in one main scanning period by the selection operation of the OLED selecting shift register 401, and rolling drive is thereby performed.

(3-1-3) Reset Circuit 430

A reset circuit 430 includes 150 reset TFTs 431 corresponding to the respective 150 DACs 440, and the source terminals of the reset TFTs 431 are connected with a reset power source Vrst. A reset signal RST is input to the gate terminal of the reset TFT 431, and the drain terminal is connected with the wiring extending from the corresponding DAC 440 to the source terminal of the OLED selecting TFT 413.

When the reset TFT 431 is turned on by the reset signal RST, the wiring extending from the corresponding DAC 440 to the source terminal of the OLED selecting TFT 413 is initialized to a reset voltage Vrst. The reset voltage Vrst may be a power source voltage Vdd or a ground voltage GND. Alternatively, the reset voltage Vrst may be an appropriate intermediate voltage Vref. Furthermore, the reset circuit 430 may be incorporated in the driver IC 302.

Instead of providing the reset circuit 430, resetting may be performed by switching the polarity of the output voltage of the DAC 440.

As described above, the print head 100 controls a gate-source voltage Vgs which is the control voltage of the OLED driving TFT 411 by inputting the pixel signal from the DAC 440 to the light emitting circuit 410, and thereby controls the light amount of the OLED 201.

(3-2) Circuit Configuration for Detecting Source-Drain Voltage Vsd

Next, a circuit configuration for detecting a source-drain voltage Vsd which is the output voltage of the OLED driving TFT 411 will be described.

When a pulse signal is input as a start signal START, the Vsd detecting shift register 420 performs a shift register operation in synchronization with a clock signal CLK and image data, and sequentially turns on one by one the Vsd detecting TFTs 414 of the light emitting circuits 410 which cause the OLEDs 201 to emit light. Thus, the drain voltage Vd of the OLED driving TFT 411 when the OLED 201 in the light emitting circuit 410 in which the Vsd detecting TFT 414 is turned on emits light is inputted by the ADC 441 and converted into a digital value.

Although the light-emission efficiency of the OLED 201 decreases according to the cumulative light emission time or the light emission amount, the rate of decrease in the light emission efficiency is so small that the light amount correction is unnecessary if the OLED 201 is caused to emit light continuously for 10 hours. Thus, since the rate of decrease in the light emission efficiency of the OLED 201 during the source-drain voltages Vsd of all 15,000 OLEDs 201 are being detected by the Vsd detecting shift register 420 is negligible, one ADC 441 is provided in the driver IC in the present embodiment.

However, when the rate of decrease in the light emission efficiency of the OLED 201 due to the increase in the cumulative light emission time cannot be ignored, or when it is necessary to detect the source-drain voltage Vsd with high accuracy, a plurality of ADCs 441 may be provided and the number of OLEDs 201 included in each ADC 441 may be reduced. Furthermore, the number of the ADCs 441 may be determined taking into consideration the wiring length and the wiring impedance from the OLED driving TFT 411 to the ADC 441.

A latch circuit 442 holds the digital value of the drain voltage Vd output from the ADC 441 as the source-drain voltage Vsd in synchronization with the clock signal CLK and the image data. Consequently, it is possible to reliably latch the source-drain voltage Vsd at the timing when the OLED 201 emits light.

There is a sampling period and a holding period in one main scanning period for each light emitting circuit 410. In these periods, the image signal is being written from the DAC 440 to the capacitor 412 during the sampling period, and the source-drain voltage Vsd of the OLED driving TFT 411 is not stabilized. Thus, the sampling period is inappropriate for detecting the source-drain voltage Vsd, and the source-drain voltage Vsd is desirably detected during the holding period.

Since the start time of the holding period is different from each light emitting circuit 410 in the light emitting block 400, in order to detect the source-drain voltage Vsd during the holding period, a delay circuit or the like for waiting without latching during the sampling period may be provided in the latch circuit 442. In this manner, it is possible to reliably latch the source-drain voltage Vsd during the holding period. The latched gate-source voltage Vgs is stored in the ASIC 310 of the controller 102.

Alternatively, by inputting a digitized value of a power source voltage Vpwr to the ADC 441 in addition to the drain voltage Vd of the OLED driving TFT 411 supplying the driving current to the OLED emitting light, the ADC 441 may calculate the source-drain voltage Vsd.

The Vsd detecting shift register 420 performs the shift register operation in synchronization with the clock signal CLK and the image data, and the reason why the image data is referred to is to detect the source-drain voltage Vsd while the driving current is being supplied by determining whether the OLED driving TFT 411, which is a detection target of the source-drain voltage Vsd, supplies the driving current to the OLED 201 to cause the OLED 201 to emit light.

Since whether to cause the OLED 201 to emit light depends on the image data, if the corresponding OLED 201 does not emit light even though the main scanning is repeated many times, neither the source-drain voltage Vsd of the OLED driving TFT 411 related to the OLED 201 nor the source-drain voltages Vsd of the other OLED driving TFTs 411 can be detected.

For this reason, if the number of times it is consecutively determined that the OLED 201 is not caused to emit light by referring to the image data for one pixel reaches a predetermined number of times, the detection of the source-drain voltage Vsd related to the pixel may be skipped, and the source-drain voltage Vsd related to the next pixel may be detected. In this manner, it is possible to prevent the problem that the source-drain voltage Vsd cannot be detected for a long period of time.

Configuration of ASIC 310

Next, the configuration of the ASIC 310 will be described.

Figure 5:
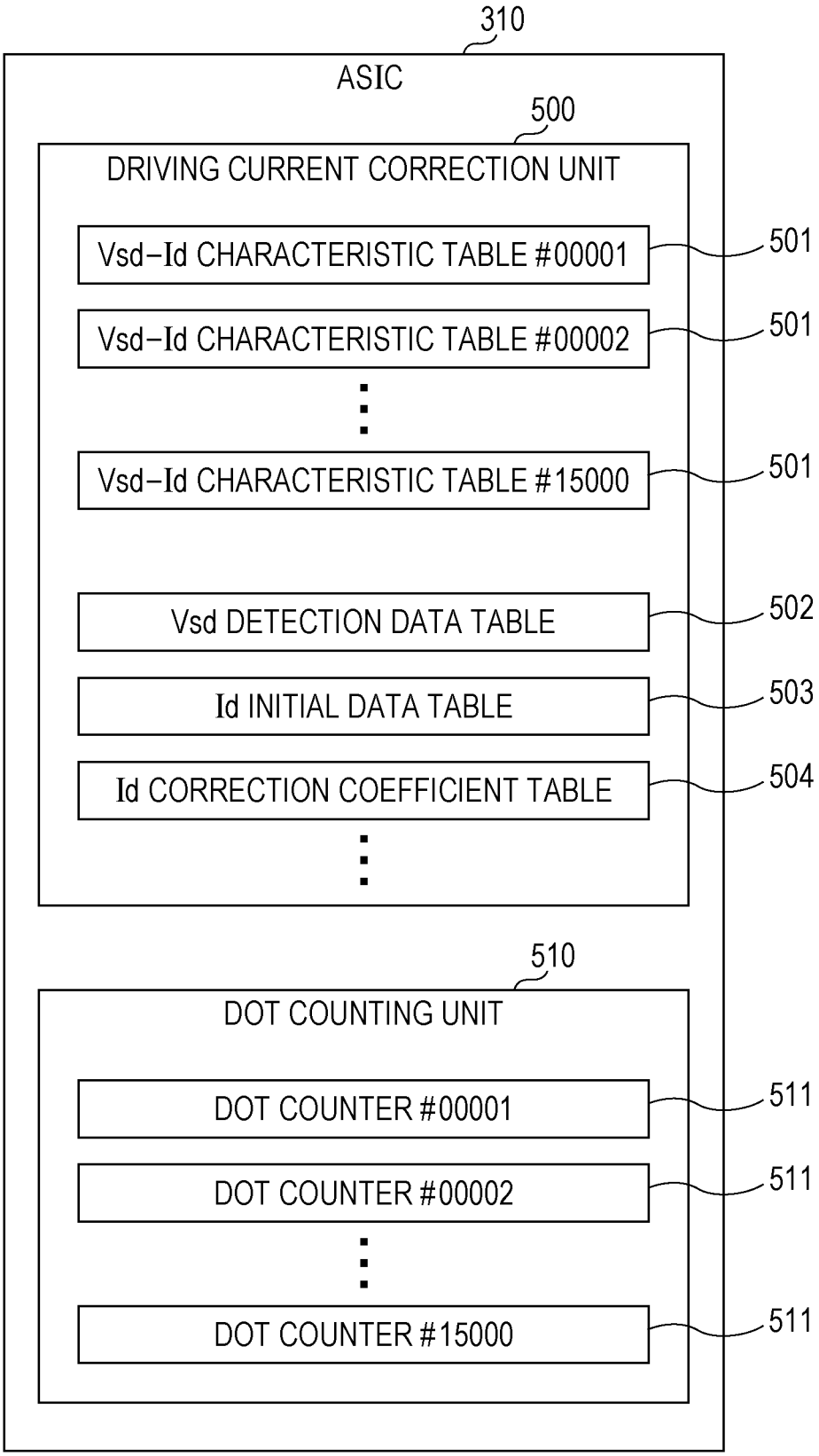
FIG. 5 is a block diagram showing a main configuration of an ASIC.

As shown in FIG. 5, the ASIC 310 includes a driving current correction unit 500 and a dot counting unit 510.

The dot counting unit 510 has 15,000 dot counters 511 corresponding to the respective OLEDs 201, and the count value of the dot counter 511 is incremented by one every time the corresponding OLED 201 is caused to emit light. Thus, the number of light-emission times of each OLED 201 is stored as cumulative light emission time.

The driving current correction unit 500 has 15,000 Vsd-Id characteristic tables 501, an Id initial data table 503 corresponding to the light amount of each OLED 201 the Vsd related to which is detected, and an Id correction coefficient table 504.

Figure 6:
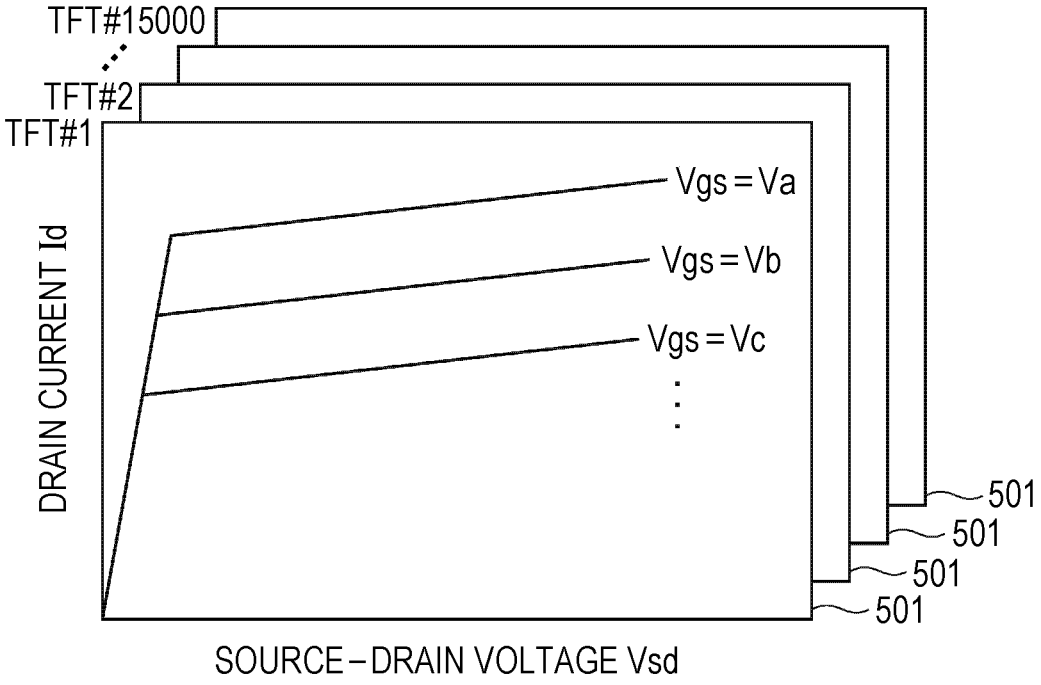
FIG. 6 is a diagram explaining a Vsd-Id characteristic table.

The Vsd-Id characteristic tables 501 are provided correspondingly to the respective 15,000 OLED driving TFTs 411. As shown in FIG. 6, the Vsd-Id characteristic tables 501 are for storing the relation between the source-drain voltage Vsd and the drain current Id for each gate-source voltage Vgs as the Vsd-Id characteristic of each OLED driving TFT 411. The drain current Id is supplied to the OLED 201 as the driving current.

The Vsd detection data table 502 is for storing the digital value of the source-drain voltage Vsd latched by the latch circuit 442 for each OLED driving TFT 411. The Vsd detection data table 502 is rewritten to the latest data every time the latch circuit 442 latches the digital value of the source-drain voltage Vsd.

As shown in FIG. 7, the Id initial data table 503 is for storing, for each OLED 201, the driving current amount Id necessary for obtaining a predetermined light amount (La, Lb, Lc, and Ld) in the initial state. The light amount is selected, for example, according to the positional relation between each OLED 201 and the rod lens array 230.

As shown in FIG. 8, the Id correction coefficient table 504 is for storing other Id correction coefficients for correcting the driving current Id for each combination of the environmental temperature, the cumulative light emission time, and the light amount.

[5] Correction Processing for Pixel Signal

The light emission efficiency of the OLED 201 changes according to the cumulative light emission time, the light amount, or the environmental temperature. The print head 100 predictively calculates the driving current Id to cause the OLED 201 having the changed light emission efficiency to emit light with a desired light amount. When the driving current Id changes accordingly, the forward voltage Vel of the OLED 201 also changes Since the potential difference between the power source Vpwr and the power source Voled applied to both ends of the circuit in which the OLED 201 and the OLED driving TFT 411 are connected in series is constant, when the forward voltage Vel of the OLED 201 changes, the source-drain voltage Vsd which is the divided voltage of the OLED driving TFT 411 changes On the other hand, the OLED driving TFT 411 has a Vsd-Id characteristic that the drain current Id increases in the saturation region as the source-drain voltage Vsd increases. Thus, when the source-drain voltage Vsd of the OLED driving TFT 411 changes, the drain current (driving current) Id also changes, and the OLED 201 cannot be caused to emit light with a desired light amount accordingly. Such variation in the light amount causes deterioration in image quality which is unacceptable for the print head.

Figure 9:
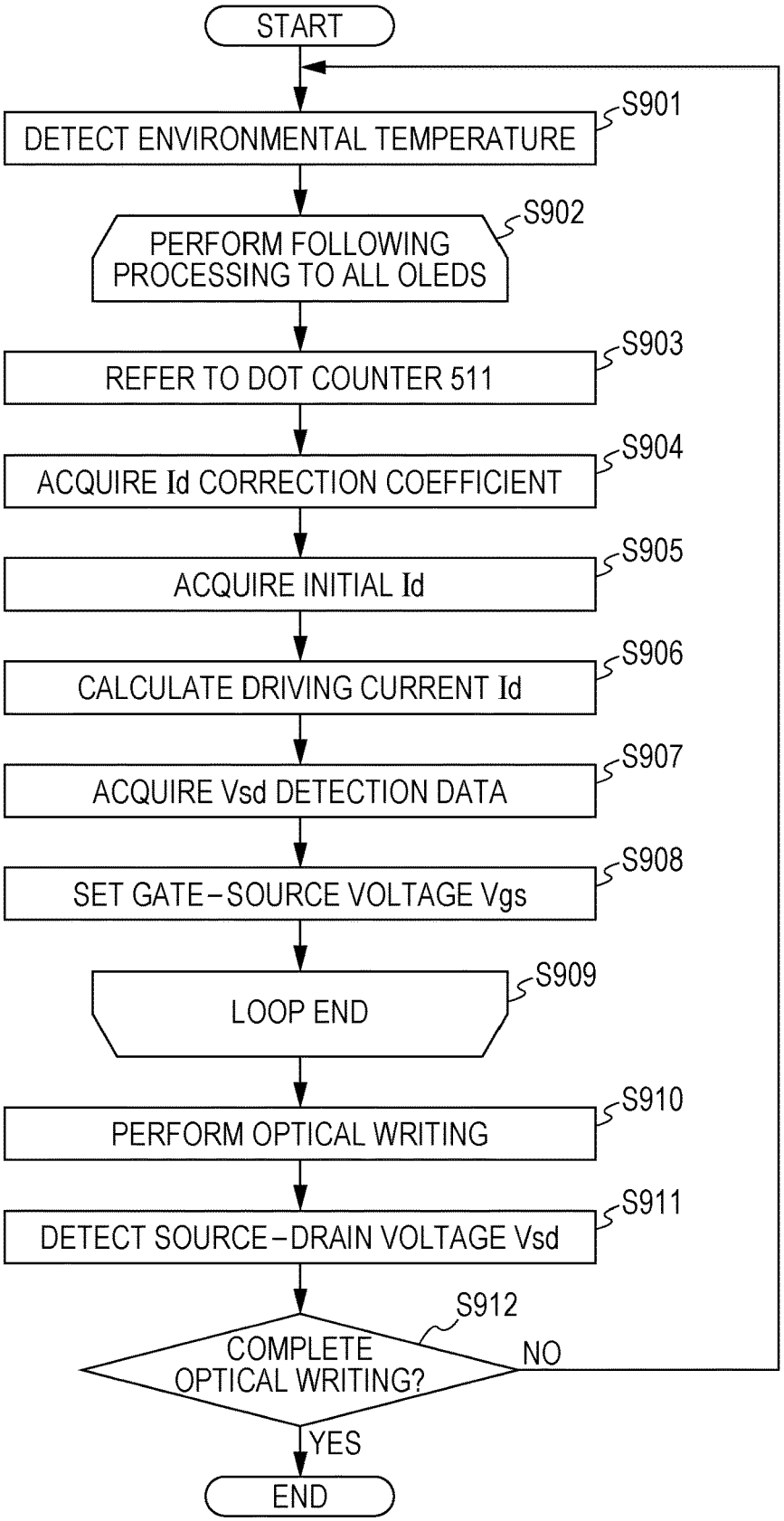
FIG. 9 is a flowchart showing processing for determining a gate-source voltage.

In order to prevent such deterioration in image quality, as shown in FIG. 9, the print head 100 first detects the environmental temperature of the OLEDs 201 with the temperature sensor 304 (S901) to perform optical writing. Next, loop processing from steps S902 to S909 is performed to all 15,000 OLEDs 201.

In this loop processing, the cumulative light emission time of the OLED 201 is acquired by referring to the dot counter 511 corresponding to the OLED 201 for each OLED 201 (S903), and the Id correction coefficient corresponding to the environmental temperature, the cumulative light emission time, and the target light amount of the corresponding OLED 201 by referring to the Id correction coefficient table 504 (S904).

Note that, the target light amount of the OLED 201 is determined according to the positional relation between the OLED 201 and the rod lens array 230, and the image forming speed. For example, since the time required for thermally fixing a toner image on a recording sheet S used for image formation varies depending on whether the sheet type of the recording sheet S is plain paper or thick paper, the image forming speed is switched. When the image forming speed is high, the exposure time is short, and the target light amount of the OLED 201 is controlled to be large. When the image forming speed is low, the target light amount is controlled to be small.

Next, the initial Id of the corresponding OLED 201 is acquired by referring to the Id initial data table 503 (S905), and the driving current amount Id is calculated with the following expression (1) (S906).

$$\text{(driving current amount Id)}=\text{(Id correction coefficient)}\times\text{(initial Id)} \quad (1)$$

In this manner, it is possible to obtain the driving current Id for causing the OLED 201 to emit light with the target light amount.

Next, the detection data of the source-drain voltage Vsd is acquired by referring to the Vsd detection data table 502 (S907), and the source-drain voltage Vsd corresponding to the combination of the driving current Id calculated using the expression (1) and the latest detected data of the gate-source voltage Vgs is determined by referring to the Vsd-Id characteristic table 501 of the OLED driving TFT 411 which supplies the driving current Id to the corresponding OLED 201 (S908).

Figure 10A:
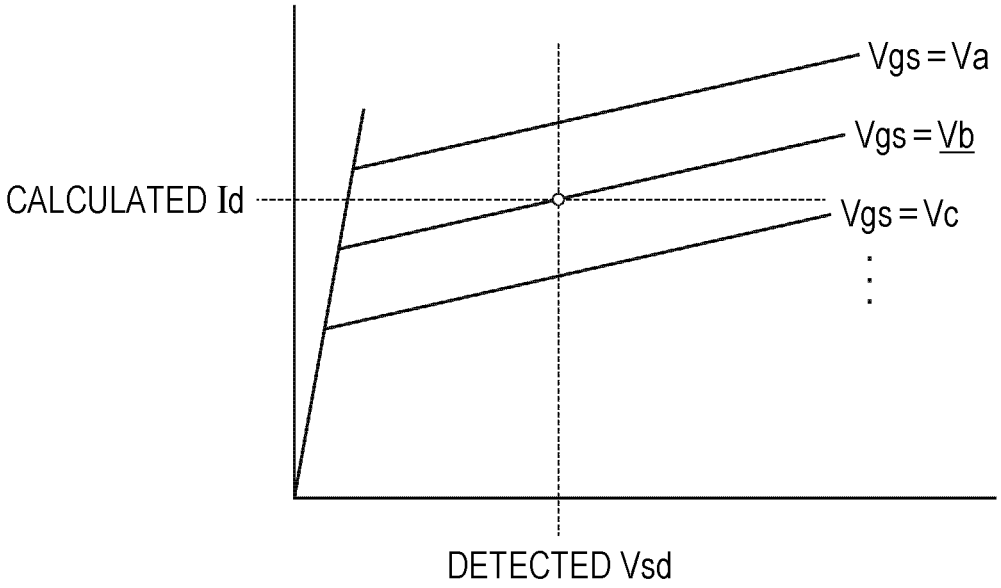
FIG. 10A is a graph showing the case in which a gate-source voltage Vgs is determined directly from the Vsd-Id characteristic table.

As shown in FIG. 10A, when a voltage Vb is detected as the gate-source voltage Vgs corresponding to the combination of the calculated driving current Id and the detected source-drain voltage Vsd by referring to the Vsd-Id characteristic table 501 of the corresponding OLED driving TFT 411, the voltage Vb is adopted as the gate-source voltage Vgs.

Figure 10B:
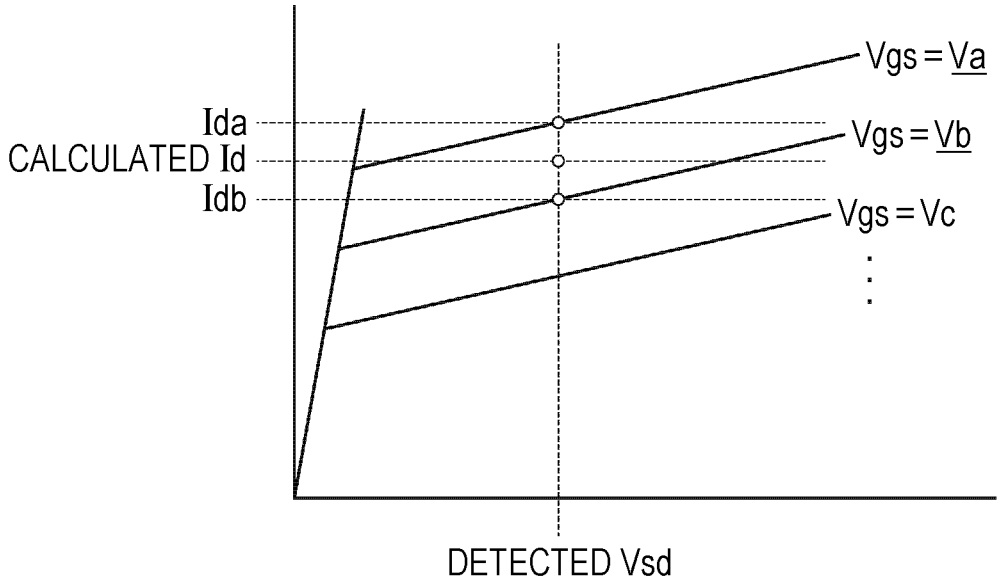
FIG. 10B is a graph showing the case in which a gate-source voltage Vgs is determined by linear interpolation from the Vsd-Id characteristic table.
Figures 11, 12:
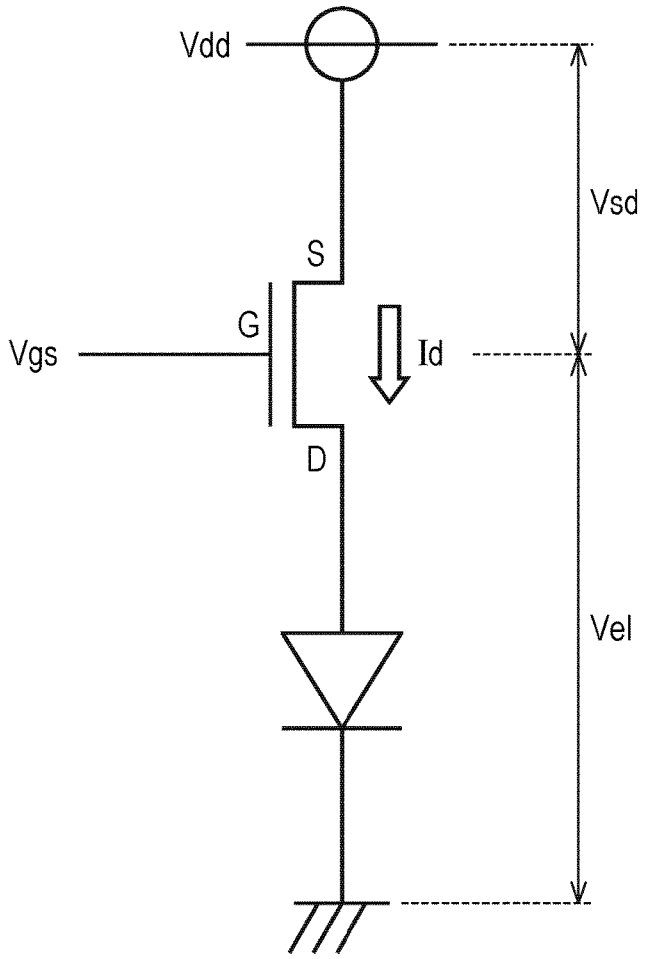
FIG. 11 is a circuit diagram showing a main configuration of a light emitting circuit.
FIG. 12 is a table showing factors of variation in a light amount of an OLED.
Figure 13:
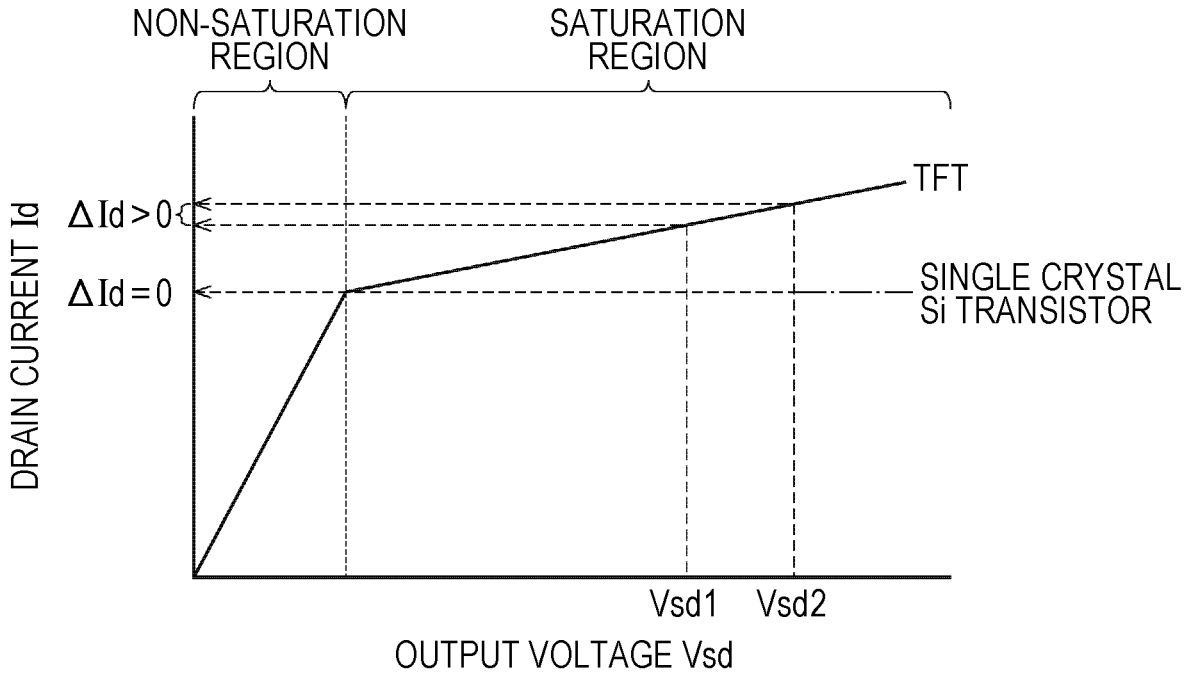
FIG. 13 is a graph explaining a Vsd-Id characteristic of a thin film transistor.

When there is no corresponding gate-source voltage Vgs in the Vsd-Id characteristic table 501, linear interpolation may be performed using the closest gate-source voltage Vgs. In the example of FIG. 10B, when the closest gate-source voltages Vgs are Va and Vb, the gate-source voltage Vgs is set by linear interpolation using the drain currents Ida and Idb corresponding to combinations of the source-gate voltages Va and Vb, and the source-drain voltage Vsd. Specifically, the gate-source voltage Vgs is calculated with the following expression (2).

$$Vgs=\{(Id-Idb)-Va+(Ida-Id)\times Vb\}/(Ida-Idb) \quad (2)$$

When the loop processing from step S902 to step S909 is ended, optical writing is performed by outputting the image signal from the DAC 440 so that the holding voltage of the capacitor 413 is to be the gate-source voltage Vgs set above (S910). In parallel with this, the source-drain voltage Vsd is detected (S911). As a result, the source-drain voltage Vsd of the Vsd detection data table 502 is rewritten to the latest data. Then, when the optical writing is completed (S912: YES), all processing is terminated.

With this processing, it is possible to suppress variation in the light amount due to the shift of the source-drain voltage Vsd in the saturation region of the OLED driving TFT 411 and the fluctuation of the forward voltage Vel of the OLED 201 without increasing costs by adding hardware.

Modification

In the above description, although the present invention has been described based on an embodiment, the present invention is not limited to the above embodiment, and the following modifications can be implemented.

(6-1) In the above embodiment, it has been described that the ASIC 310 stores the Vsd-Id characteristic table 501 and the Id correction coefficient table 504, but the present invention is not limited to this case, and the Vsd-Id characteristic or the Id correction coefficient may be calculated using arithmetic expressions instead of the tables.

(6-2) In the above embodiment, it has been described that the gate-source voltage Vgs is set by actually measuring the source-drain voltage Vsd of the OLED driving TFT 411, but the present invention is not limited to this case, and the gate-source voltage Vgs may be set by predicting the forward voltage from the cumulative light emission time of each OLED 201 and calculating the source-drain voltage Vsd of the corresponding OLED driving TFT 411.

With this setting, the accuracy of the gate-source voltage Vgs is lower than the case in which the source-drain voltage Vsd of the OLED driving TFT 411 is actually measured as described in the above embodiment. However, since the Vsd detecting shift register 420, the Vsd detecting TFT 414, the ADC 441, the latch circuit 442, and the like are unnecessary, there are advantages of reduction in part costs, improvement of the yield of the TFT substrate 300, downsizing of the print head 100, and the like.

(6-3) In the above embodiment, it has been described that the Vsd detecting TFT 414 for detecting the source-drain voltage Vsd is selected using the Vsd detecting shift register 420, but the present invention is not limited to this case, and the Vsd detecting TFT 414 may be selected using a random access circuit.

(6-4) In the above embodiment, it has been described that the OLED driving TFT 411 is a p-channel, but the present invention is not limited to this case, and the effect of the present invention is the same if the OLED driving TFT 411 is an n-channel.

(6-5) In the above embodiment, it has been described that the source-drain voltage Vsd of the OLED driving TFT 411 is detected, but the present invention is not limited to this case, and the forward voltage Vel of the OLED 201 may be detected instead. The effect of the present invention is the same if either one is detected.

(6-6) In the above embodiment, it has been described that the print head 100 includes one ADC 441, but the present invention is not limited to this case, and the print head 100 may include two or more ADCs 441 instead.

In this case, the Vsd detecting shift register 420 is provided for each ADC 441, and each detecting shift register 420 sequentially turns on the Vsd detecting TFT 414 under its control, and inputs the source-drain voltage Vsd to the corresponding ADC 441. The latch circuit 442 is also provided for each ADC 441 and latches the digital signal output from the ADC 441.

(6-7) In the above-described embodiment, it has been described that the OLED is used as the light emitting element, but the present invention is not limited to this case, and the same effect can be obtained using a current-driven non-single crystal light emitting element other than the OLED.

(6-8) In the above embodiment, it has been described that the driving current amount is corrected according to the cumulative light emission time, the environmental temperature, and the light amount, but the present invention is not limited to this case, and the driving current amount may be corrected according to any one or any two of the cumulative light emission time, the environmental temperature, and the light amount. Alternatively, the driving current amount may be corrected based on factors other than the above. The effect of the present invention is the same regardless of how to determinate the driving current.

(6-9) In the above embodiment, it has been described that the OLED selecting TFT 412 and the Vsd detecting TFT 414 are used, but the present invention is not limited to this case, and switching elements other than TFTs may be used instead of the OLED selecting TFT 412 and the Vsd detecting TFT 414.

(6-10) In the above embodiment, it has been described that the Vsd-Id characteristic tables 501 are prepared for 15,000 OLED driving TFTs 411, but the present invention is not limited to this case, and the Vsd-Id characteristic table 501 may be as follows.

For example, one Vsd-Id characteristic table 501 may be prepared in common for all OLED driving TFTs 411. Alternatively, the OLED driving TFTs 411 having the common Vsd-Id characteristic may share the Vsd-Id characteristic table 501. Consequently, it is possible to reduce the storage capacity required to store the Vsd-Id characteristic table 501. Thus, it is possible to reduce the component costs of the memory elements and the manufacturing costs for incorporating the memory elements, and to downsize the print head 100.

(6-11) In the above embodiment, it has been described that the image forming apparatus is a tandem type color printer apparatus, but the present invention is not limited to this case, and the present invention may be applied to a color printer apparatus or a monochrome printer apparatus. Furthermore, if the present invention is applied to a single-function machine such as a copier equipped with a scanner or a facsimile machine having a communication function, or a multifunction peripheral (MFP) having these functions, the same effect can be obtained.

A print head and an image forming apparatus according to an embodiment of the present invention are useful as an apparatus for correcting variation in a light amount due to fluctuation of a voltage in the forward direction of an OLED and a characteristic of a TFT which supplies a driving current to the OLED.

According to an embodiment of the invention, a control voltage to be applied to each of a plurality of thin film transistors when next light is emitted according to a detected output voltage of each of the plurality of thin film transistors and a driving current to cause each of a plurality of light emitting elements to emit light with a target light amount, and it is possible to suppress variation in a light amount due to shift of a source-drain voltage Vsd in a saturation region of the TFT and fluctuation of a forward voltage Vel of the OLED.

The determiner may determine, for each of the plurality of thin film transistors based on a Vsd-Id characteristic of a corresponding one of the plurality of thin film transistors, a control voltage corresponding to a combination of the output voltage Vsd detected by the detector and a driving current amount Id for causing one of the plurality of light emitting elements corresponding to the one of the plurality of thin film transistors to emit light with the target light amount as the control voltage.

In this case, a driving current amount determiner that determines a driving current amount Id to be supplied to the plurality of light emitting elements according to the target light amount using an LUT or a function may be provided. Furthermore, a temperature detector that detects an environmental temperature of the plurality of light emitting elements may be provided, and the driving current amount determiner may determine a driving current amount according to the environmental temperature. Furthermore, a cumulative light emission time recorder that records a cumulative light emission time for each of the plurality of light emitting elements may be provided, and the driving current amount determiner may determine a driving current amount of a corresponding one of the plurality of light emitting elements according to the cumulative light emission time.

Furthermore, a plurality of capacitors that is provided in one-to-one correspondence with the plurality of thin film transistors and each holds a control voltage applied to a corresponding one of the plurality of thin film transistors may be provided, a main scanning period during which optical writing for one line is performed is divided into sampling periods for inputting the control voltage to each of the plurality of capacitors, each of the plurality of capacitors may hold the control voltage during a holding period which is a period other than its own sampling period in the main scanning period, and the detector may detect, during the holding period of one of the plurality of capacitors, the output voltage of one of the plurality of thin film transistors corresponding to the one of the plurality of capacitors.

Furthermore, when detecting an output voltage of one of the plurality of thin film transistors, the detector may detect the output voltage after one of the plurality of light emitting elements corresponding to the one of the plurality of thin film transistor emits light by referring to image data designating necessity of light emission for each of the plurality of light emitting elements, and then detect the output voltage of a next one of the plurality of thin film transistors.

In this case, the detector may count up the number of non-light emission times that the one of the plurality of light emitting elements corresponding to the one of the plurality of thin film transistors does not emit light continuously for each main scanning period during which optical writing for one line is performed, and detect, when the number of non-light emission times reaches a predetermined number of times, the output voltage of the next one of the plurality of thin film transistors without detecting the output voltage of the one of the plurality of thin film transistors.

Furthermore, the detector may include a shift register or a random access circuit that selects the one of the plurality of thin film transistors. Furthermore, the plurality of light emitting elements may be OLEDs.

An image forming apparatus according to the present invention includes the print head according to the present invention.

Although embodiments of the present invention have been described and illustrated in detail, it is clearly understood that the same is by way of illustration and example only and not limitation, the scope of the present invention should be interpreted by terms of the appended claims

What is claimed is:

1. A print head comprising:

a plurality of current-driven non-single crystal light emitting elements arranged in a line;

a plurality of thin film transistors that is provided in one-to-one correspondence with the plurality of light emitting elements and each supplies a driving current to a corresponding one of the plurality of light emitting elements;

a detector that detects, when one of the plurality of light emitting elements corresponding to one of the plurality of thin film transistors emits light, an output voltage of the one of the plurality of thin film transistors; and a hardware processor that determines a control voltage to be applied to each of the plurality of thin film transistors when next light is emitted according to the output voltage of the one of the plurality of thin film transistors detected by the detector and a driving current to be supplied by each of the plurality of thin film transistors to cause each of the plurality of light emitting elements to emit light with a target light amount, wherein the hardware processor determines, for each of the plurality of thin film transistors based on a Vsd-Id characteristic of a corresponding one of the plurality of thin film transistors, a control voltage corresponding to a combination of the output voltage Vsd detected by the detector and a driving current amount Id for causing one of the plurality of light emitting elements corresponding to the one of the plurality of thin film transistors to emit light with the target light amount as the control voltage.

2. The print head according to claim 1, wherein the hardware processor determines the driving current amount Id to be supplied to the plurality of light emitting elements according to the target light amount using an LUT or a function.

3. The print head according to claim 2, further comprising:

a temperature detector that detects an environmental temperature of the plurality of light emitting elements, wherein the hardware processor determines a driving current amount according to the environmental temperature.

4. The print head according to claim 2, wherein the hardware processor records a cumulative light emission time for each of the plurality of light emitting elements and determines a driving current amount of a corresponding one of the plurality of light emitting elements according to the cumulative light emission time.

5. The print head according to claim 1, further comprising:

a plurality of capacitors that is provided in one-to-one correspondence with the plurality of thin film transistors and each holds a control voltage applied to a corresponding one of the plurality of thin film transistors, wherein a main scanning period during which optical writing for one line is performed is divided into sampling periods for inputting the control voltage to each of the plurality of capacitors, each of the plurality of capacitors holds the control voltage during a holding period which is a period other than its own sampling period in the main scanning period, and the detector detects, during the holding period of one of the plurality of capacitors, the output voltage of one of the plurality of thin film transistors corresponding to the one of the plurality of capacitors.

6. The print head according to claim 1, wherein when detecting an output voltage of one of the plurality of thin film transistors, the detector detects the output voltage after one of the plurality of light emitting elements corresponding to the one of the plurality of thin film transistor emits light by referring to image data designating necessity of light emission for each of the plurality of light emitting elements, and then detects the output voltage of a next one of the plurality of thin film transistors.

7. The print head according to claim 6, wherein the detector counts up the number of non-light emission times that the one of the plurality of light emitting elements corresponding to the one of the plurality of thin film transistors does not emit light continuously for each main scanning period during which optical writing for one line is performed, and detects, when the number of non-light emission times reaches a predetermined number of times, the output voltage of the next one of the plurality of thin film transistors without detecting the output voltage of the one of the plurality of thin film transistors.

8. The print head according to claim 6, wherein the detector comprises a shift register or a random access circuit that selects the one of the plurality of thin film transistors.

9. The print head according to claim 1, wherein the plurality of light emitting elements are OLEDs.

10. An image forming apparatus comprising the print head according to claim 1.

11. A print head comprising:

a plurality of current-driven non-single crystal light emitting elements arranged in a line;

a plurality of thin film transistors that is provided in one-to-one correspondence with the plurality of light emitting elements and each supplies a driving current to a corresponding one of the plurality of light emitting elements;

a detector that detects, when one of the plurality of light emitting elements corresponding to one of the plurality of thin film transistors emits light, an output voltage of the one of the plurality of thin film transistors; and a hardware processor that determines a control voltage to be applied to each of the plurality of thin film transistors when next light is emitted according to the output voltage of the one of the plurality of thin film transistors detected by the detector and a driving current to be supplied by each of the plurality of thin film transistors to cause each of the plurality of light emitting elements to emit light with a target light amount, wherein when detecting an output voltage of one of the plurality of thin film transistors, the detector detects the output voltage after one of the plurality of light emitting elements corresponding to the one of the plurality of thin film transistor emits light by referring to image data designating necessity of light emission for each of the plurality of light emitting elements, and then detects the output voltage of a next one of the plurality of thin film transistors.

12. The print head according to claim 11, wherein the detector counts up the number of non-light emission times that the one of the plurality of light emitting elements corresponding to the one of the plurality of thin film transistors does not emit light continuously for each main scanning period during which optical writing for one line is performed, and detects, when the number of non-light emission times reaches a predetermined number of times, the output voltage of the next one of the plurality of thin film transistors without detecting the output voltage of the one of the plurality of thin film transistors.

13. The print head according to claim 11, wherein the detector comprises a shift register or a random access circuit that selects the one of the plurality of thin film transistors.

14. The print head according to claim 11, wherein the plurality of light emitting elements are OLEDs.

15. An image forming apparatus comprising the print head according to claim 11.

* * * * *